US005474175A

United States Patent [19]

Gattis

[11] Patent Number: 5,474,175

[45] Date of Patent: Dec. 12, 1995

[54] GOLF BAG

[76] Inventor: Doyle E. Gattis, 610 McDaniel Mill Rd., Conyers, Ga. 30207

[21] Appl. No.: 240,380

[22] Filed: May 10, 1994

[51] Int. Cl.[6] ..... A63B 55/00; A63B 55/02; A63B 55/06

[52] U.S. Cl. ..... 206/315.3; 206/315.5; 206/315.7; 248/96

[58] Field of Search ..... 206/315.3, 315.7, 206/315.8, 315.9; 248/96

[56] References Cited

U.S. PATENT DOCUMENTS

| | | | |
|---|---|---|---|
| 1,471,766 | 10/1923 | Wolfe | 206/315.7 X |
| 1,880,351 | 10/1932 | McDonald | 248/96 |
| 1,924,182 | 8/1933 | Fritz | 206/315.7 X |
| 1,954,413 | 4/1934 | Hunter | 206/315.7 X |
| 1,970,849 | 8/1934 | Gunther | 248/96 |
| 2,186,491 | 1/1940 | Meyer | 206/315.7 |
| 2,324,439 | 7/1943 | Thommen | 206/315.7 X |
| 2,408,777 | 10/1946 | Holbrook | 206/315.7 |
| 2,571,088 | 10/1951 | Walton | 248/96 |
| 2,768,668 | 10/1956 | Santosuosso | 206/315.7 |
| 3,195,844 | 7/1965 | Roepke | 206/315.7 X |
| 3,455,358 | 7/1969 | Kuzma | 248/96 |
| 4,767,001 | 8/1988 | Kim | 206/315.8 X |
| 4,834,235 | 5/1989 | Solheim et al. | 206/315.7 |
| 4,898,352 | 2/1990 | Hoffman | 206/315.7 X |
| 4,949,844 | 8/1990 | Yang | 206/315.7 |
| 5,036,974 | 8/1991 | Ross, Jr. | 206/315.7 |
| 5,038,984 | 8/1991 | Izzo | 206/315.3 X |
| 5,082,218 | 1/1992 | Hoffman | 206/315.7 X |
| 5,102,529 | 4/1992 | Hickin | 206/315.7 |
| 5,154,377 | 10/1992 | Suk | 206/315.7 X |
| 5,178,273 | 1/1993 | Igarashi | 206/315.7 |
| 5,236,085 | 8/1993 | Quellais | 206/315.7 |
| 5,339,951 | 8/1994 | Chen | 206/315.7 |
| 5,340,063 | 8/1994 | Hsieh | 206/315.7 X |
| 5,356,003 | 10/1994 | Gretz et al. | 206/315.7 |
| 5,358,109 | 10/1994 | Nichols | 206/315.7 X |

FOREIGN PATENT DOCUMENTS

| | | | |
|---|---|---|---|
| 11632 | of 1929 | Australia | 206/315.3 |
| 3480 | of 1893 | United Kingdom | 206/315.6 |
| 1928 | 1/1909 | United Kingdom | 206/315.6 |
| 23350 | of 1911 | United Kingdom | 248/96 |
| 103282 | 1/1917 | United Kingdom | 248/96 |
| 398550 | 9/1933 | United Kingdom | 206/315.6 |

*Primary Examiner*—Sue A. Weaver
*Attorney, Agent, or Firm*—John Lezdey

[57] ABSTRACT

The present invention provides a golf bag or container for carrying a plurality of golf clubs. The bag is made out of a rigid cylindrical body with a pair of support legs pivotally attached to the body for supporting the bag in an upright position on the ground, which permits easy access to the golf clubs. A linkage member including a pair of linkage arms terminating in a slider are slidably moveable within a slotted member to control the position of the legs. A separable fastener connects the legs to an out-of-the-way position against the body while the bag is being carried by the user. Also disclosed is a single, elongated strap threaded through a series of aligned slots.

4 Claims, 2 Drawing Sheets

GOLF BAG

BACKGROUND AND SUMMARY OF THE INVENTION

The present invention relates to golf bags, and in particular to a lightweight rigid golf bag or container structure having extendable legs for supporting the bag in a generally upright position for easy access to golf clubs stored therein.

There have been a variety of golf bags known in the prior art for carrying golf clubs by a golf player during the playing of a game of golf. Because many individuals walk during the playing of the game and carry their own golf bags, there have been many attempts to create lightweight bag structures which are easy to handle and carry to further enhance the enjoyment of a player's game. Conventional prior art golf bags have independent self-supporting legs which enable a player to remove a bag from his shoulder, place the bag against the earth, and support the bag in a tripod position to permit easy access to the clubs stored therein. Examples of prior art golf bags of this type are shown in U.S. Pat. Nos. 1,471,766 to Wolfe, 1,693,889 to Dick, 1,954,413 to Hunter, 2,186,491 to Meyer, 2,324,439 to Thommen, 2,768,668 to Santosuosso, 4,834,235 to Solheim et al. 4,949,844 to Yang, 5,036,974 to Ross, 5,082,218 to Hoffman, 5,154,377 to Suk, 5,178,273 to Igaroshi and 5,236,065 to Quellain, among others.

The present invention relates to an improved golf bag or container structure of the type described hereinabove, including a rigid, impact resistant, lightweight golf bag or container having a pair of pivotably mounted legs with a unique pivot structure to enable the legs to be pivoted to a tripod position for supporting the bag or container upright. The invention further includes a separable fastener attached between the legs and the rigid bag body or container so that the legs may be fixed against the bag out of the way while the bag is being carried. This arrangement permits the legs to be easily pivoted to a tripod support position by releasing the separable fastener when the bag or container is placed on the ground.

Among the objects of the present invention are the provision of a rigid, impact resistant, lightweight golf bag having a pivoting leg structure which enables the bag to be maintained in an upright position, permitting easy access to the bag.

Another object of the present invention is to provide a golf bag in which the support legs of the bag are positioned against the body of the bag so as not to interfere with a player carrying the bag while he is walking between shots.

A further object of the invention is to produce a golf bag or container which can be easily and cheaply manufactured.

Additional features and advantages of the invention will be set forth in the description which follows, and in part, will be apparent from the description, or may be learned by practice of the invention. The objects and other advantages of the invention will be realized and obtained by the combinations particularly pointed out in the written description and claims, as well as the drawings.

Both the foregoing general description and the following detailed description are exemplary and explanatory only. The accompanying drawings are included to provide a further understanding of the invention and are incorporated in and constitute part of the specification to illustrate the preferred embodiment of the invention, and together with the description, serve to explain the principles of the invention.

DESCRIPTION OF THE PREFERRED EMBODIMENTS

Figure 1:
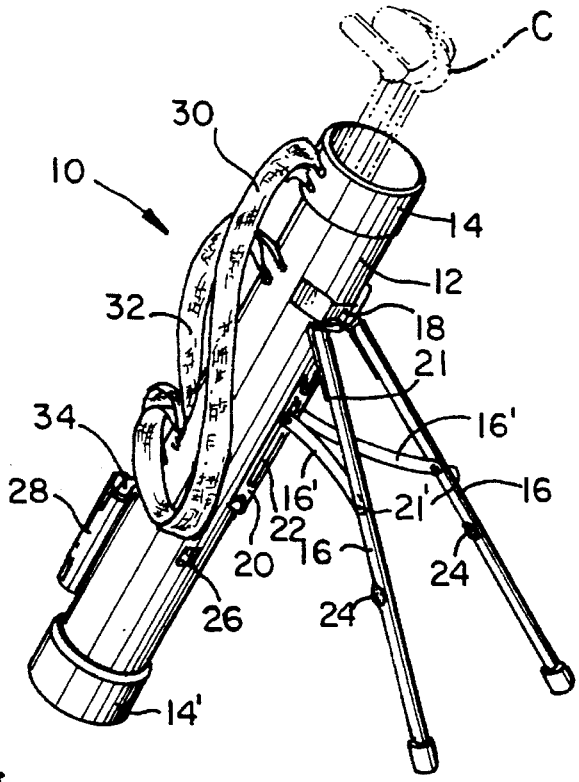
FIG. 1 is a perspective view of a golf bag in accordance with the present invention, with the legs extended and the bag positioned in a generally upright position.
Figure 6:
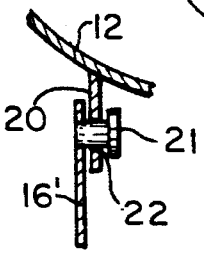
FIG. 6 is an exploded view of the slider and linkage structure of the invention.
Figure 5:
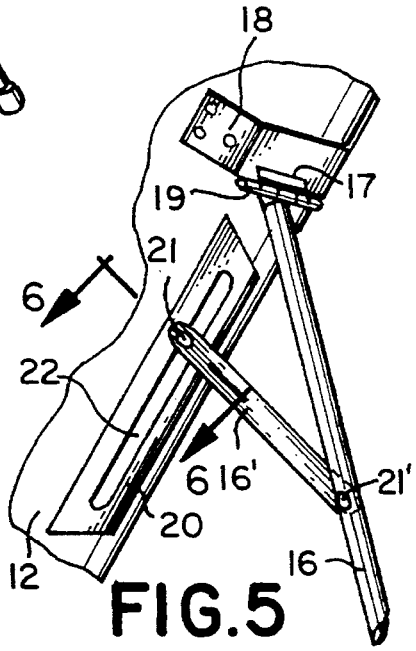
FIG. 5 is a detailed view of the hinge and linkage structure of the invention.
Figure 2:
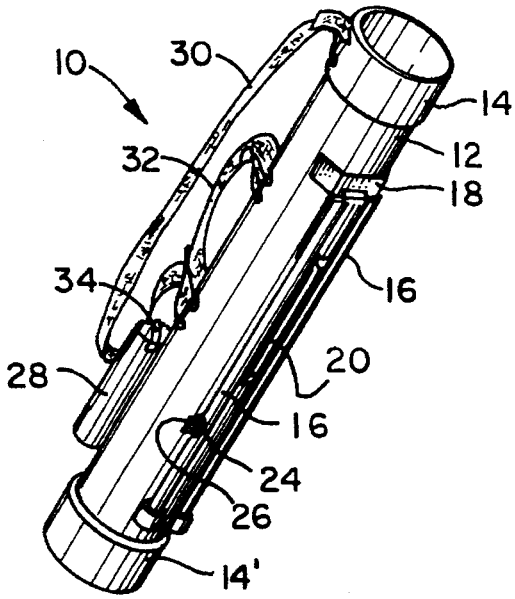
FIG. 2 is a perspective view of a golf bag of the present invention, with the legs in a retracted position and held against the body of the bag.

Reference will now be made in detail to the present preferred embodiments of the invention, examples of which are illustrated in the accompanying drawings. Wherever possible, like references will be used to refer to like parts.

Referring to the drawings, the improved golf bag 10 of the present invention is formed of a generally cylindrical, elongated tubular-shaped body 12 sized to receive and carry a plurality of golf clubs C. The body 12 includes an upper support rim 14 and a lower base 14' which closes the bottom of the device. The base 14' may be integral with the body 12 or in the form of a separable cap. It will be appreciated that the structure provides an opening 15 at the upper end of the bag body 12 into which the clubs are placed. The golf bag 10 is provided with legs 16, the upper ends of which are pivotably attached to the body 12 by means of a bracket 18 and hinges 19 connecting the ends of the legs 16 and the bracket 18. The bracket 18 includes stop members 17 which engage the ends of the legs 16 to limit the pivotable movement thereof to be confined within the area defined by the arc connecting the extended legs 16 to the body 12.

Figure 4:
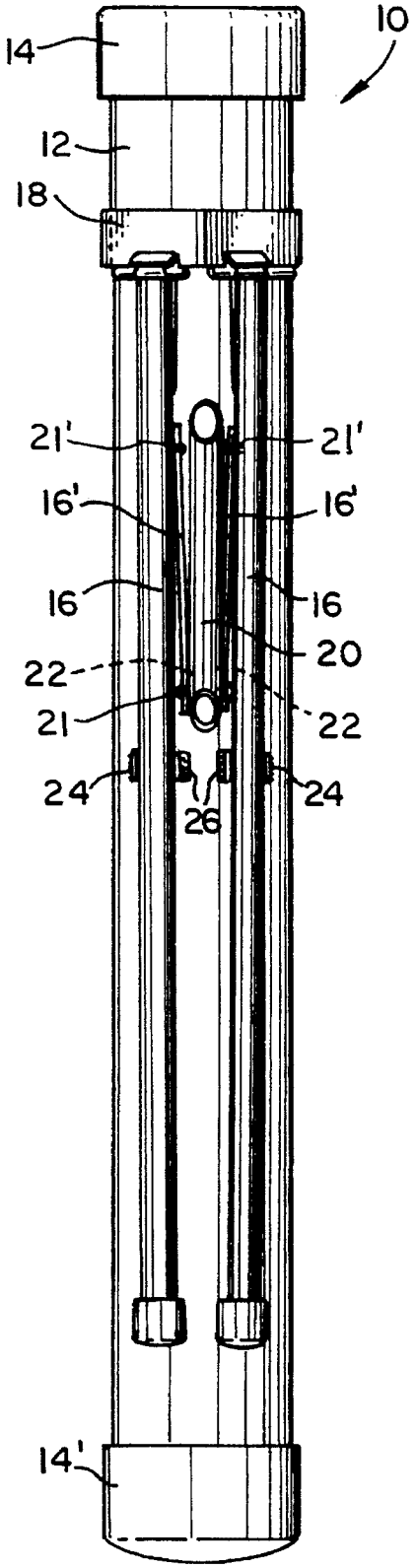
FIG. 4 is a rear elevational view of the golf bag of FIG. 1.

Preferably, the back 10 is made of heavy-duty, high-impact resistant plastic which will protect the clubs and also provide a solid surface for attachment of the legs 16. Each leg 16 is provided with linkage including a linkage arm 16' and a pivot pin 21'. One end of the linkage arm 16' is connected to the leg 16 with the pivot pin 21'. The other end of the linkage arm 16' is connected to a member 20 with a slider 21. Similarly, as seen in FIGS. 1 and 4, one end of a second linkage arm 16' is connected to a second leg 16 with a second pivot pin 21', while the other end of the second linkage arm 16' is connected to the member 20 and slider 21 that are connected to the first linkage arm 16'. The slider 21 moves within an elongated slot 22 formed in the member 20 which is rigidly attached to the body 12. This structure permits pivotally moving the legs 16 from a position adjacent to the bag body 12 to an angular position located therefrom as the slider 21 moves within the slot 22. As shown in FIG. 1, when the legs 16 are extended away from the body 12, the legs 16 and the body 12 form a tripod arrangement, enabling the bag to be positioned in a nearly upright position to allow easy access to the golf clubs C when the bag is not being carried by a player.

Figure 3:
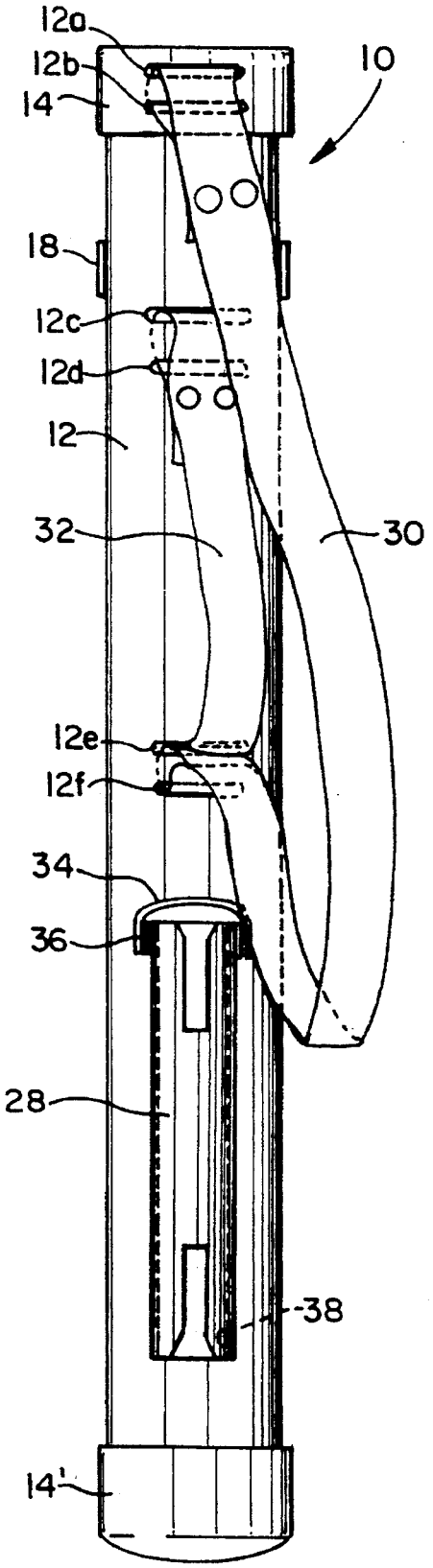
FIG. 3 is a front elevational view of the golf bag of FIG. 1.

The bag 10 also includes a flexible strap 30 which is carried on the shoulder of the player, and a handle 32 which enables the bag to be lifted; both the handle 32 and strap 30 being formed from a single elongated flexible strip of material, such as a woven fabric. As seen in FIG. 3, the straps 30 and 32 are attached to the golf bag 10 by means of slots 12*a*, 12*b*, 12*c*, 12*d*, 12*e* and 12*f* formed in the body 12 of the bag. The bag also includes a cylindrical, rigid golf ball holder 28 having a closure member 34 secured by a separable fastener 36 to enable a player to carry a supply of golf balls 38.

The legs 16 are held against the bag body 12 when the bag is being carried, using a pair of complementary separable fasteners; one portion 24 of each fastener being secured to the legs 16 and the complementary portion 26 of each fastener being secured to the bag body 12.

In use, when a player is ready to hit a shot, the strap 30 is removed from the shoulder, and the bag 10 is positioned with the base 14' on the ground. The legs are then pivotably moved to the tripod position (as shown in FIG. 1) by detaching the separable fastener members 24–26 and allowing the slider 21 to slide upwardly within the slot 22.

After the golfer plays a shot, it becomes a simple matter to lift the bag up onto his shoulder using the strap 30 for support and pivot the legs back against the bag body 12, where they are held in position by the separable fasteners 24–26.

It will be apparent to those skilled in the art that other modifications and variations can be made in the golf bag of the present invention without departing from the spirit or scope of the invention. Thus, it is intended that the present invention cover the modifications and variations of this invention, provided these come within the scope of the appended claims and their equivalents.

I claim:

1. A container for carrying a plurality of golf clubs comprising:

a rigid elongated plastic body having a top opening and base; support legs for supporting the container in an upright position, said legs having a fixed end pivotally attached to said body;

a linkage member, including a pair of linkage arms, one arm attached to each leg, said arms terminating in a slider;

a slotted member formed on said container comprising an elongated slot to receive said slider for sliding movement therein, said linkage member, said linkage arms and said slider enabling said legs to be pivotally moved toward and away from said body, wherein the support legs and base provide a tripod position for supporting the container in an upright position;

a bracket connected to said elongated body to which the fixed ends of said legs are attached, said bracket being shaped to conform to the shape of said body;

stop members connected to said bracket for limiting the movement of said legs relative to said body;

hinges connected between said legs and said bracket for pivotally attaching said legs to said bracket;

strap means for lifting and supporting said container by a user, wherein said means is a unitary, elongated, flexible strap and handle combination formed from a unitary, elongated, flexible strip of material attached to said body; said body having a plurality of longitudinally aligned slots for attachment of said strap thereto so that said strap is threaded through said aligned slots.

2. The container of claim 1 further including separable fastener means connected to said body and to said legs for maintaining said legs in position against said body when the container is carried by the user.

3. The container of claim 1 wherein said elongated body of said container is formed of a rigid cylinder.

4. The container of claim 1 further including means for holding a supply of golf balls rigidly attached to said container body.

* * * * *